US006346040B1

(12) United States Patent
Best

(10) Patent No.: US 6,346,040 B1
(45) Date of Patent: Feb. 12, 2002

(54) SOFFIT TO ATTIC VENT

(76) Inventor: Tim Best, 3205 Burnside Line, Orillia, Ontario (CA), L3V 6G4

( * ) Notice: Subject to any disclaimer, the term of this patent is extended or adjusted under 35 U.S.C. 154(b) by 0 days.

(21) Appl. No.: 09/814,069

(22) Filed: Mar. 22, 2001

(30) Foreign Application Priority Data

Sep. 26, 2000 (CA) ..... 2320590

(51) Int. Cl.[7] ..... F24F 7/02

(52) U.S. Cl. ..... 454/260; 454/365; 454/364; 52/198

(58) Field of Search ..... 454/364, 365, 454/366, 367, 260; 52/95, 199, 198

(56) References Cited

U.S. PATENT DOCUMENTS

| | | | |
|---|---|---|---|
| 3,972,167 | A | 8/1976 | Vogeli |
| 4,007,672 | A | 2/1977 | Luckey |
| 4,102,092 | A | 7/1978 | Ward |
| 4,125,971 | A | 11/1978 | Ward |
| 4,126,973 | A | 11/1978 | Luckey |
| 4,184,416 | A | 1/1980 | Koontz |
| 4,189,878 | A | 2/1980 | Fitzgerald |
| 4,197,683 | A | 4/1980 | Ward |
| 4,214,510 | A | 7/1980 | Ward |
| 4,237,672 | A | 12/1980 | Peterson |
| 4,265,060 | A | 5/1981 | Woodhams |
| 4,269,007 | A | 5/1981 | Ward |
| 4,406,095 | A | 9/1983 | Slavik |
| 4,658,552 | A | 4/1987 | Mulford |
| 4,660,463 | A | 4/1987 | Bottomore et al. |
| 4,776,262 | A | 10/1988 | Curran |
| 4,815,250 | A | 3/1989 | Mulford |
| 5,007,216 | A | 4/1991 | Pearson |
| 5,022,314 | A | 6/1991 | Waggoner |
| 5,035,172 | A | 7/1991 | Waggoner |
| 5,094,054 | A | 3/1992 | Arends |
| 5,122,095 | A | 6/1992 | Wolfert |
| 5,288,269 | A | 2/1994 | Hansen |
| 5,341,612 | A | 8/1994 | Robbins |
| 5,457,920 | A | 10/1995 | Waltz |
| 5,596,847 | A | 1/1997 | Stephenson |
| 5,826,383 | A | 10/1998 | Garrison |
| 5,918,425 | A | 7/1999 | Archard et al. |

*Primary Examiner*—Pamela Wilson
*Assistant Examiner*—Derek S. Boles
(74) *Attorney, Agent, or Firm*—Elias C. Borges

(57) ABSTRACT

A ventilation baffle for use in building roofs includes a rectangular sheet dived by a plurality of fold lines into a rectangular central portion and a pair of side edge portions on opposite sides of the central portion. The edge portions are further divided into a pair of flange portions and a pair of spacer portions. The edge portions are bendable upward to form upstanding sides, the first pair of flange portions being bendable outwardly to form tabs which are attachable to the roof sheeting, said spacer portions separating the central portion of the sheet from the tabs and defining an air-flow passageway between the central portion and the roof sheeting. The sheet also has an end portion which can be bent downwardly to define an outer end wall between adjacent roof rafters which can be further positioned to contact the top plate of the roof for attachment.

9 Claims, 4 Drawing Sheets

SOFFIT TO ATTIC VENT

FIELD OF THE INVENTION

This invention relates generally to soffit to attic vents or ventilation baffles for permitting the free flow of ventilation air between roof rafters.

BACKGROUND OF THE INVENTION

In order to maintain the integrity of home attic insulation, it is necessary to ensure adequate air ventilation between the roofing boards and the attic insulation. If the roofing boards contacts the attic insulation, there is a possibility that the free flow of ventilation air will be restricted and the integrity of the insulating material will be degraded due to the build-up of condensation and ice. Over the years, various insulation vents and ventilation baffles have been developed to ensure a free flow of air between the roof insulation and the roof boards. These vents generally take the form of elongated troughs which are mounted between the roof rafters or trusses. A precut piece of insulating batting or a stop board is then placed between the wall plate and the troughs to prevent spillage of loose fill insulation into the soffit area. Quite often, this batting or stop board is installed improperly, leading to heat loss and or mouldy interior comers.

Several designs for ventilation baffles have been proposed which purport to eliminate or reduce the likelihood of attic insulation, particularly loose fill insulation, from falling into the soffit area. Two such devices are disclosed in U.S. Pat. No. 4,265,060 to Woodhams and U.S. Pat. No. 4,189,878 to Fitzgerald. Both of these structures have a downwardly extending wall at one end which contacts the upper wall plate. This downwardly extending wall prevents insulation from falling into the soffit area. While both the Woodhams and Fitzgerald devices may be effective, their structures make them very difficult to install from the inside of the home while maintaining both rafter to rafter and roofboard to wall plate adjustability. Furthermore, prior air vents may inadvertently act as vapour barriers between the insulation and the trough's ventilation area, which may result in the build-up of ice or condensation on the surface of the insulation side of the vent. Therefore, there is a need for an effective soffit to attic which is inexpensive to manufacture, easy to install from the inside, and yet remains effective for both truss and stick frame applications.

SUMMARY OF THE INVENTION

The present invention is a ventilation baffle and stop for use in buildings having walls made of wall studs, wall plates mounted on top of the wall studs, said wall plates having a top surface and a front surface facing away from an interior of the building, a plurality of spaced apart roof rafters mounted on top of the top surface of the wall plates, and roof sheathing mounted on top of the roof rafters. The ventilation baffle made in accordance with the present invention includes a substantially rectangular sheet of stiff material having opposite first and second ends and opposite first and second side edges. The sheet has a first pair of longitudinally extending, parallel, fold lines respectively located close to the opposite side edges of the sheet, said first pair of fold lines dividing the sheet into a rectangular central portion and a first pair of elongated rectangular side edge portions on opposite sides of said central portion. The sheet also includes a second pair of longitudinally extending, parallel, fold lines respectively located between and extending parallel to, the first fold lines and the opposite side edges, said second pair of fold lines dividing the first pair of elongated rectangular side edge portions into a first pair of flange portions positioned adjacent the side edges and a first pair of spacer portions positioned adjacent the central portion. The first pair of elongated rectangular side edge portions are bendable upward relative to the central portion to form upstanding sides, the first pair of flange portions being bendable outwardly relative to the central portion to form tabs position able adjacent the opposing surfaces of a pair of adjacent roof rafters, said tabs being attachable to an inside surface of the roof sheeting mounted onto the roof rafters, said first pair of spacer portions separating the central portion of the sheet from the tabs and defining an air-flow passageway between the central portion and the roof sheeting. The sheet also has a transversely extending fold line located towards the first end and defining an outer rectangular end portion so that said rectangular end portion can be positioned adjacent to and above the top plate and can be bent downwardly relative to the central portion to define an outer downwardly extending end wall between the opposing surfaces of a pair of adjacent roof rafters and extending downwardly from said central portion substantially into contact with said top plate, said end wall being attachable to the plate.

Other features and advantages of the invention will be evident from the following detailed description when read in conjunction with the accompanying drawings which illustrate the invention.

DETAILED DESCRIPTION OF THE EMBODIMENT

Figure 1:
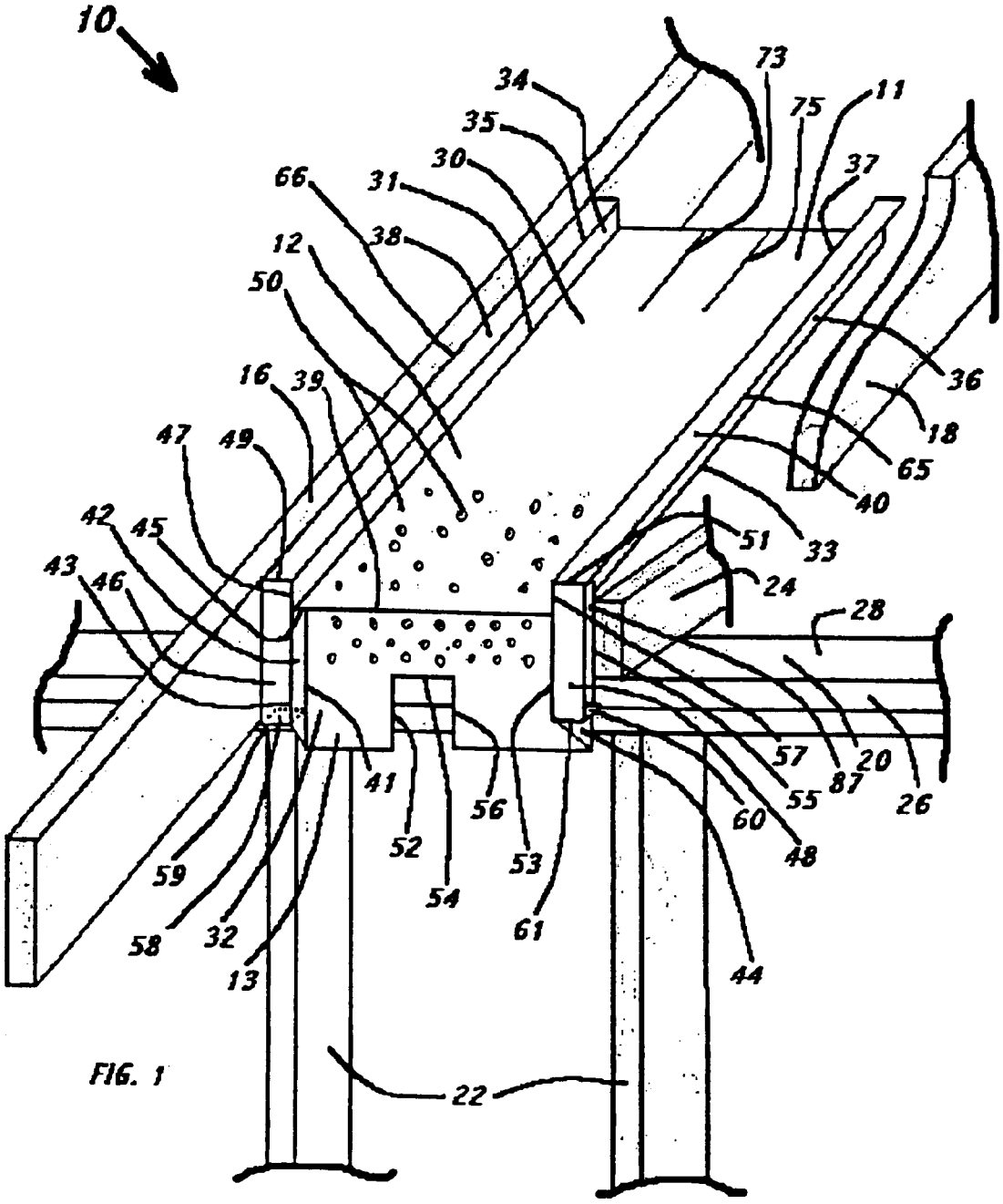
FIG. 1: is a prospective view of a portion of a house construction showing the relative position of the insulation vent of the present invention as installed.

Referring firstly to FIG. 1, a house construction is shown generally as item 10 and consists of a plurality of roof rafters 16 and 18, which are mounted on top of upper wall plate 20. Upper wall plate 20 is in turn mounted on top of wall studs 22. The insulation vent of the present invention is shown generally as item 12 and is mounted between roof rafters 16 and 18. Insulation vent 12 consists of sheet 30, extensions 34 and 36, flanges 38 and 40, opposite ends 11 and 13, wall 32, flanges 48 and 46, extensions 42 and 87, and tabs 58 and 60. Extensions 34 and 36 extend integrally upward from side fold lines 31 and 33, respectively of sheet 30. Support flanges 38 and 40 extend integrally and transversely outward from spacer flanges 34 and 36, respectively. Wall 32 extends integrally downward from sheet 30 and has side folds 41 and 55. Extensions 42 and 44 extend integrally outwards from wall 32 at folds 41 and 55, respectively. Flanges 46 and 48 extend transversely outward from flanges 42 and 44, respectively. Tabs 58 and 60 extend transversely backward from the lower ends of flanges 46 and 48, respectively.

Figure 3:
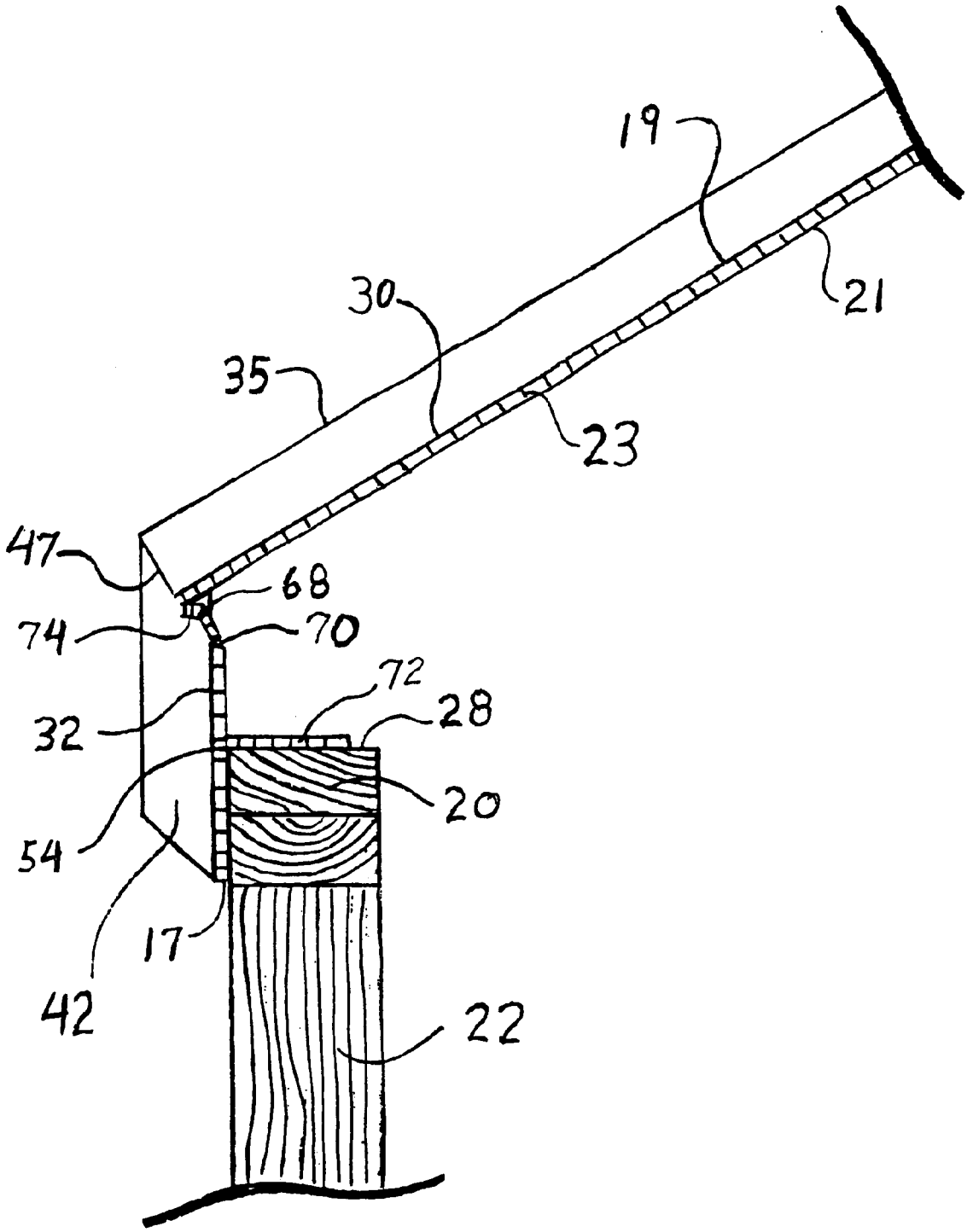
FIG. 3: is a vertical sectional view through a roof and wall, showing the insulation vent of the invention installed into position.

Vent 12 is mounted between rafters 16 and 18 such that the edges 66 and 65 of support flanges 38 and 40 contact rafters 16 and 18, respectively. Support flanges 38 and 40 are mounted to the roof sheathing (not shown) which is in turn mounted on top of rafters 16 and 18. Wall 32 is mounted to top rail 20 such that wall 32 lies flush against front face 26 of top plate 20. Wall 32 has a centrally disposed, elongated tongue 72 (see FIG. 3) which is used to mount wall 32 to top plate 20. As best seen in FIG. 3, tongue 72 extends over a portion of top surface 28 of wall plate 20 and can be rigidly secured to wall plate 20 by means of tacks or staples. Extensions 34 and 36 separate sheet 30 from the roof sheathing (not shown) and thereby provides an air passageway permitting air to circulate between the roof sheathing and sheet 30. Flanges 38, 46 and tab 58 are all continuous and make physical contact with rafter 16. Similarly, flanges 40, 48 and tab 60 also make physical contact with rafter 18 thereby minimizing the leakage of insulation between the interior of the attic and the air passage way formed by the roofing sheets and sheet 30.

Figure 2:
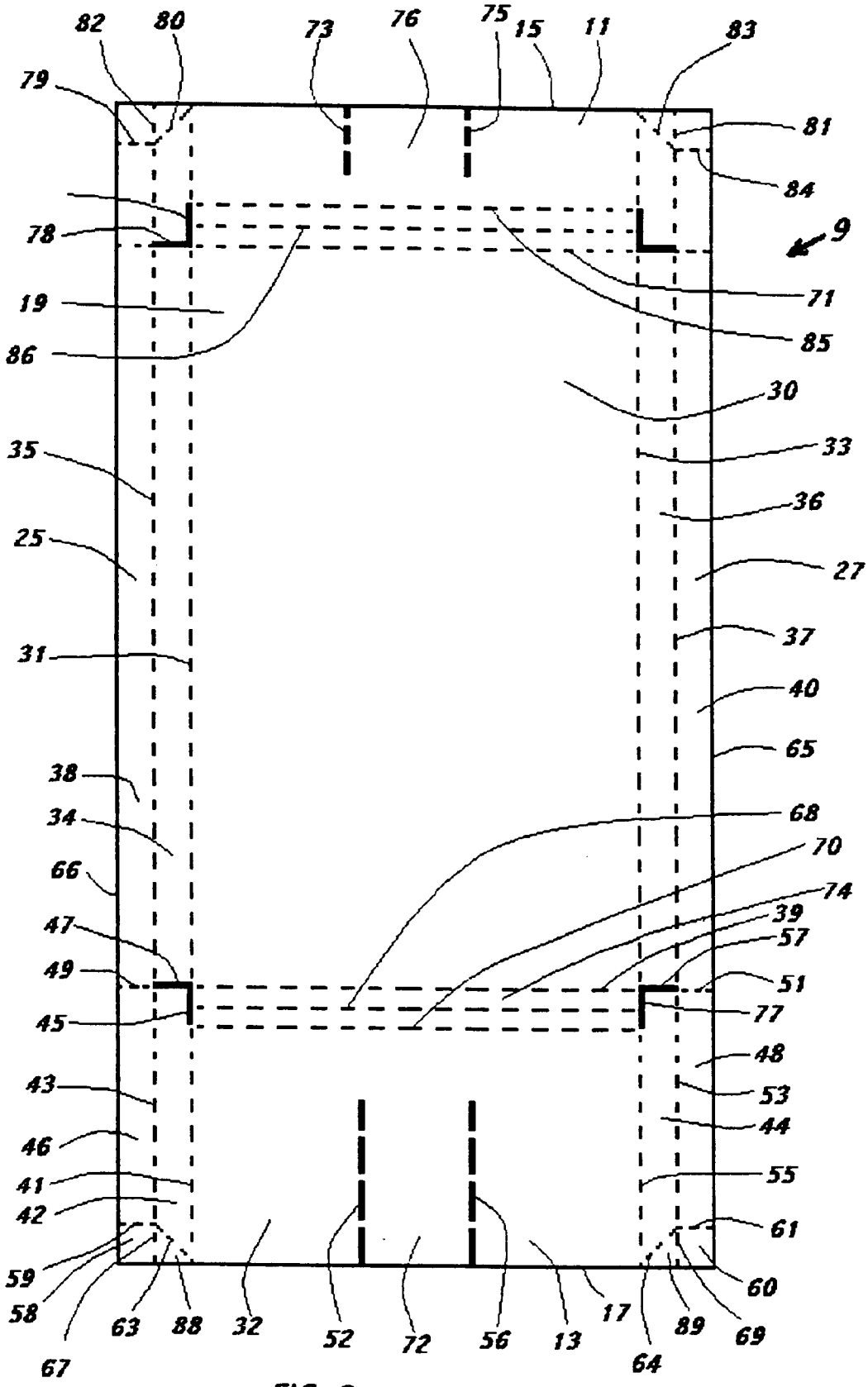
FIG. 2: is a top view of a roof insulation vent of the invention in it's preformed, flattened condition.
Figure 4:
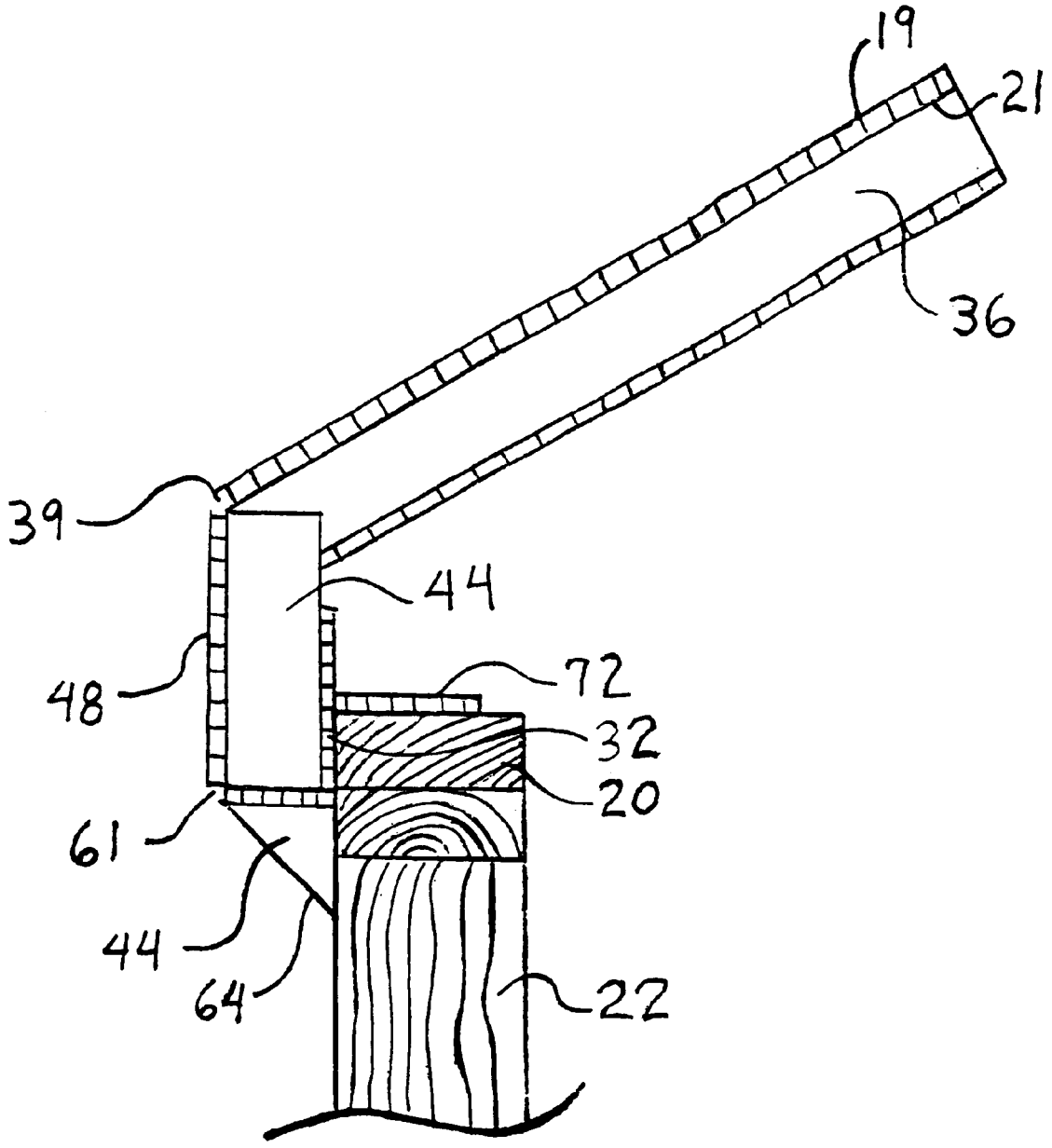
FIG. 4: is a vertical sectional view through a roof and wall and showing one side of the insulation vent of the invention installed into position.

Referring now to FIGS. 2, 3 and 4 ventilation baffle 12 is formed from a single sheet (shown generally as Item 9) of stiff material such as corrugated cardboard, waxed corrugated cardboard, corrugated plastic board, or foamed plastic board. The various flanges and extensions are formed as a result of folds and cuts made to the sheet material. Preferably the sheet material consists of an elongated rectangular sheet having opposite ends 11 and 13 and opposite sides 25 and 27. Flanges 38 and 40 are formed by parallel folds 35 and 37 which are adjacent sides 25 and 27, respectively. Depending on the nature of the material used to form the sheet, folds 35 and 37 can be either simple folds or score lines. If the material forming the sheet is corrugated cardboard or waxed corrugated cardboard, then folds 35 and 37 may comprise simple folds. However, if the material forming the sheet is plastic corrugated sheathing, then folds 35 and 37 should be scored to permit the material to bend. As better seen in FIG. 3, sheet 12 has a top surface 19 and a bottom surface 21. If the material comprising sheet 12 consists of corrugated plastic sheets, then top surface 19 and bottom surface 21 will be separated by a multitude of ribs 23. To permit the material to easily bend in an upward direction, bottom surface 21 is cut while top surface 19 remains intact. Conversely, if a downwardly oriented bend is required, top surface 19 is cut, while surface 21 remains intact. In this way, the material may be bent easily, even if the material itself is quite stiff. Preferably, bends 35 and 37 represent score lines on top surface 19. Extensions 34 and 36 are formed as a result of an upward bend along lines 31 and 33, respectively. Again, bend lines 31 and 33 are preferably score lines on bottom surface 21 of sheet 12.

Wall 32 is formed from sheet 12 by bending along score line 39, which is again a scoring of top surface 19. Flanges 46 and 48 are formed by bending at score lines 43 and 55, respectively, while extensions 42 and 44 are formed by bending at score lines 41 and 55, respectively. Tabs 58 and 60 are formed from bending along score lines 67 and 69 as well as score lines 59 and 61, respectively. Comers 88 and 89 of wall 32 must be folded inward to form the completed baffle, so they are provided with score lines 63 and 64, respectively. Flange 74 is formed by folding the sheet along score lines 39 and 70. To ensure that extensions 44 and 42 do not interfere with the placement of wall 32 against top plate 20, cuts 47 and 45 and cuts 57 and 77, respectively, permit the edges of extensions 42 and 44, positioned adjacent the cuts, to move relative to the rest of the sheet, when the sheet is folded into the form shown in FIG. 1. FIG. 4 illustrates how a corner of extension 44 overlies extension 36 when the sheet is folded into shape. Referring to FIG. 3, wall 32 is secured to wall plate 20 via tongue 72. Tongue 72 is formed by perforations 52 and 56 (see FIG. 2) and is bent backwardly at bend line 54 so that wall 72 lies flat on top surface 28 of wall plate 20. Tongue 72 may be secured to top plate 20 via staples or nails.

The installation of the air vent will now be discussed with reference to FIGS. 1 & 2. Firstly, sheet 9 is folded along the various fold lines to form the vent as illustrated in FIG. 1. Tongue 72 is then formed by tearing along perforated lines 52 and 56 and the Tongue is secured to top surface 28 of plate 20 with staples and wall 32 is thereby secured to front faced 26. Flanges 38 and 40 are then positioned adjacent rafters 16 and 18, respectively and secured to the roofing boards (not shown) via tacks or nails. Since fold lines 35, 37, 33 and 31 permit flanges 38 and 40 as well as extensions 34 and 36 to move relative to each other, flanges 38 and 40 can be moved relative to each other to permit vent 12 to be mounted between the rafters, even if there is slight differences in the rafter spacing. Because of the flexibility of flanges 38 and 40 due to the fold lines 35, 31, 33 and 37, flanges 38 and 40 may be positioned towards each other or away from each other by several centimetres. This makes it very easy to install vent 12 between the rafters. Also, the diameter of flanges 38 between edges 66 and fold 35 permits the installer to staple flange 38 to the roofing sheet (not shown) simply by inserting a staple gun between rafter 16 and extension 34. Likewise, the width of extension 40 also permits a staple gun to be inserted between extension 36 and rafter 18. Hence, the diameters of flanges 38 and 40 permit the user to install vent 20 from the inside of the structure. Preferably, flanges 38 and 40 have a diameter of between one to two inches, to permit ease of installation. The edges of sheet 9 are folded to form flanges 46 and 48 and tabs 58 and 60. The edges of these flanges and tabs make contact with rafters and the wall plate, thereby minimizing the amount of loose fill insulation that can spill out into the soffit area. The diameters of flanges 48 and 46 are also selected such that the vent can be used in stick and frame constructions. Preferably, the diameters of flanges 48 and 46 are between 1" to 2" to accommodate ceiling joist 24.

Referring back to FIG. 2, sheet 12 has opposite ends 11 and 13. End 13 is folded as previously disclosed such that wall 32 forms an insulation stop. The size of the insulation stop defined by wall 32 is determined by the distance separating edge 17 from fold line 70. It will be appreciated that not all roof constructions are the same, and in some cases a different sized insulation stop will be required. Therefore, opposite end 11 of sheet 12 is provided with fold lines 71, 86, 85, 79, 80, 81, 82, 83 and 84, which are analagous to fold lines 39, 68, 70, 59, 63, 69, 67, 64, and 61 of opposite end 13. Fold lines 71, 86, 85, 79, 80, 82, 83 and 84 permit opposite end 11 to be folded to form an insulation stop. Since the distance between fold line 85 and edge 15 is different than the distance between fold line 70 and edge 17, the insulation stop formed at end 11 will likewise be of different size. End 11 is also provided with tongue 76 which is formed between perforated lines 73 and 75. Tongue 76 can serve the same function as tongue 72, previously described, if end 11 is used to form an insulation stop.

A specific embodiment of the present invention has been disclosed; however, several variations of the disclosed device could be envisioned as within the scope of this invention. It is to be understood that the present invention is not limited to the embodiments described above, but encompasses any and all embodiments within the scope of the following claims.

Therefore the claims are:

1. A ventilation baffle and stop for use in buildings having walls made of wall studs, wall plates mounted on top of the wall studs, said wall plates having a top surface and a front surface facing away from an interior of the building, a plurality of spaced apart roof rafters mounted on top of the top surface of the wall plates, and roof sheathing mounted on top of the roof rafters, the ventilation baffle comprising a substantially rectangular sheet of stiff material having:

opposite first and second ends and opposite first and second side edges, a first pair of longitudinally extending, parallel, fold lines respectively located close to the opposite side edges, said fold lines dividing the sheet into a rectangular central portion and a first pair of elongated rectangular side edge portions on opposite sides of said central portion, a second pair of longitudinally extending, parallel, fold lines respectively located between and extending parallel to, the first fold lines and the opposite side edges, said second pair of fold lines dividing the first pair of elongated rectangular side edge portions into a first pair of flange portions positioned adjacent the side edges and a first pair of spacer portions positioned adjacent the central portion, said first pair of elongated rectangular side edge portions being bendable upward relative to the central portion to form upstanding sides, the first pair of flange portions being bendable outwardly relative to the central portion to form tabs positionable adjacent the opposing surfaces of a pair of adjacent roof rafters, said tabs being attachable to an inside surface of the roof sheeting mounted onto the roof rafters, said first pair of spacer portions separating the central portion of the sheet from the tabs and defining an air-flow passageway between the central portion and the roof sheeting, said sheet also having a transversely extending fold line located towards the first end and defining an outer rectangular end portion so that said rectangular end portion can be positioned adjacent to and above the top plate and can be bent downwardly relative to the central portion to define an outer downwardly extending end wall between the opposing surfaces of a pair of adjacent roof rafters and extending downwardly from said central portion substantially into contact with said top plate, said end wall being attachable to the plate.

2. A ventilation baffle as defined in claim 1 wherein the first and second pair of fold lines permit the tabs to be moved transversely relative to the central portion between a first position wherein the tabs are positioned towards the central portion and a second position wherein the tabs are positioned away from the central portion.

3. A ventilation baffle as defined in claim 1 wherein the sheet has a plurality of perforations for permitting moisture to pass through the sheet.

4. A ventilation baffle as defined in claim 2 wherein the sheet has a plurality of perforations for permitting the moisture to pass through the sheet.

5. A ventilation baffle as defined in claim 2 wherein the outer rectangular end portion has opposite side edges and wherein the first pair of longitudinally extending, parallel, fold lines extend into the rectangular end portion to divide the end portion into a rectangular central wall portion and a second pair of elongated rectangular side edge portions on opposite sides of said central wall portion, and wherein the second pair of longitudinally extending, parallel, fold lines extend into the outer rectangular end portion and divides the second pair of elongated rectangular side edge portions into a second pair of flange portions positioned adjacent the side edges and a second pair of spacer portions positioned adjacent the central wall portion, said second pair of elongated rectangular side edge portions being bendable upward relative to the central wall portion to form upstanding sides, the second pair of flange portions being bendable outwardly relative to the central wall portion to form a second pair of tabs positionable adjacent the opposing surfaces of a pair of adjacent roof rafters.

6. A ventilation baffle as defined in claim 5 wherein the first and second pair of fold lines permit the second pair of tabs to be moved transversely relative to the central wall portion between a first position wherein the second pair of tabs are positioned towards the central wall portion and a second position wherein the second pair of tabs are positioned away from the central wall portion.

7. A ventilation baffle as defined in claim 1 wherein the end wall is provided with a pair of substantially parallel perforation lines extending longitudinally from the first end of the sheet, said pair of perforation lines defining an elongated tongue portion between the perforation lines, said tongue being detachable from the end wall along said perforation lines, said tongue being bendable downwardly relative to the end wall, said tongue being attachable to the top plate to secure the end wall to the top plate.

8. A ventilation baffle as defined in claim 1 wherein the first pair of flange portions each have a diameter, said diameter defined as the space between the second fold line and the side edge of each of the respective first pair of flange portions, said diameter selected to permit a user to easily mount the flange portions to the roof sheeting.

9. A ventilation baffle as defined in claim 8 wherein the diameter of the first pair of flange portions is substantially between one and two inches.

* * * * *